US005701993A

United States Patent [19]

Whitlow et al.

[11] Patent Number: 5,701,993

[45] Date of Patent: Dec. 30, 1997

[54] POROSITY-FREE ELECTRICAL CONTACT MATERIAL, PRESSURE CAST METHOD AND APPARATUS

[75] Inventors: Graham A. Whitlow, Murrysville; Mehmet N. Gungor, Pittsburgh; William R. Lovic, New Kensington, all of Pa.

[73] Assignee: Eaton Corporation, Cleveland, Ohio

[21] Appl. No.: 257,990

[22] Filed: Jun. 10, 1994

[51] Int. Cl.[6] ..... H01H 1/02

[52] U.S. Cl. ..... 200/264; 200/269; 200/265

[58] Field of Search ..... 200/266, 267, 200/268, 269, 270, 264, 265

[56] References Cited

U.S. PATENT DOCUMENTS

| | | | |
|---|---|---|---|
| 3,547,180 | 12/1970 | Cochran et al. . | |
| 3,818,163 | 6/1974 | Robinson | 200/264 |
| 3,821,505 | 6/1974 | Wood | 200/264 |
| 4,372,783 | 2/1983 | Kato | 200/264 |
| 4,503,010 | 3/1985 | Kippenberg et al. | 200/264 |
| 4,508,158 | 4/1985 | Amateau et al. . | |
| 4,573,517 | 3/1986 | Booth et al. . | |
| 4,889,177 | 12/1989 | Charbonnier et al. . | |
| 5,111,871 | 5/1992 | Cook . | |
| 5,113,925 | 5/1992 | Cook . | |
| 5,420,384 | 5/1995 | Okutomi et al. | 200/264 |

*Primary Examiner*—David J. Walczak
*Attorney, Agent, or Firm*—Martin J. Moran

[57] ABSTRACT

A 100% dense, porosity free copper-chromium contact has been prepared in which deleterious porosity has been eliminated. This copper-chromium contact has been produced by pressurizing liquid copper to infiltrate an evacuated chromium based, lightly sintered, highly porous preform. The electrical contact has one of either a homogeneous Cr distribution and a graded Cr distribution. The apparatus used to effect the molten metal infiltration has two independent, physically separated chambers—a first cold chamber and a second hot chamber. The first chamber is under no applied pressure except inside a gating system used to transfer molten Cu into the porous preform in the first chamber. The new contact has about 15–30% Cr material and a high erosion resistant contact surface. The graded Cr distribution has a Cr rich layer with about 25–50% by weight Cr, an intermediate Cr layer with about 15–20% by weight Cr, a low Cr layer with about 5–15% Cr and a Cr poor layer with about 1–5% Cr above a copper substrate.

3 Claims, 3 Drawing Sheets

POROSITY-FREE ELECTRICAL CONTACT MATERIAL, PRESSURE CAST METHOD AND APPARATUS

BACKGROUND OF THE INVENTION

1. Field of the Invention

This invention relates to electrical contacts for use in power interruption and control devices and more particularly concerns an improved contact with a 100% dense, porosity-free microstructure having enhanced electrical interruption performance. A copper-chromium contact has been prepared in which deleterious porosity has been eliminated. This copper-chromium contact has been produced by pressurizing liquid copper to infiltrate an evacuated chromium based, lightly sintered, highly porous preform.

BACKGROUND INFORMATION

It is well known to use a basic contact in a device such as a vacuum interrupter. Typically the contact is attached to a copper electrode by brazing. One family of the more common contact alloys is based on the copper-chromium system. Sometimes with the addition of other elements.

Two current methods of fabricating contacts are powder metallurgy processing (P/M) and capillary pressure infiltration. These two techniques are well-established but both have inherent problems.

One problem that has arisen during the recent past with regard to contacts produced by these two methods is related to contact surface erosion and/or welding resulting in a reduction in life of the contacts and hence in the interrupter/contactor life. The prior P/M based contacts typically exhibit a few percent porosity or have an actual sintered density of 96–98% of the theoretical density. Capillary pressure driven contact infiltration techniques suffer from solidification shrinkage porosity, which is due to shrinkage of molten Cu upon solidification. The presence of the ≧2–4% porosity in contacts adversely affects the performance of the contacts in the vacuum interruption tubes. This 2–4% porosity is thought to provide are anchoring sites on the contact surface, which in contact with the resulting stationary arc can lead to rapid, local erosion, and hence, reduced contact life. Furthermore, because the porosity may contain some residual gases, when an arc is initiated at the porosity sites, these residual gases will leave the contact and cause an increase in partial vacuum pressure in the vacuum tube thereby reducing the performance of the vacuum interrupter.

Another problem of the P/M method was the inability to tailor the Cu—Cr composition and microstructure. The ability to vary Cr particulate size and composition as a function of location was nearly impossible. By the same token, the Cr composition of the inner bulk regions of the contact was difficult to dilute to improve thermal conductivity and to reduce the cost of raw materials via savings on expensive Cr consumption per contact.

Finally, the P/M technique is a very expensive technique in terms of contact manufacturing.

SUMMARY OF THE INVENTION

Applicants have made a novel and improved contact, which eliminates the observed porosity in contacts made by both conventional powder metallurgical and infiltration based processing using pressure infiltration. Applicants have invented a copper-chromium contact in which such deleterious porosity has been eliminated. The 100% dense, porosity free contact is produced by pressurizing liquid copper to infiltrate an evacuated chromium based, lightly sintered, highly porous preform.

An improved contact is made from a blended Cr and Cu powder mixture. A contact made from the above powders is about 15–30% by weight Cr material. A 50% by weight Cr/50% by weight Cu of mesh size of about −325/−325, gives a preform volume void fraction of about 0.61 and a preform volume Cr fraction of about 0.22. A 25% by weight Cr/25% by weight Cr/50% by weight Cu of mesh size of about −325/100 to 200/−325 gives a preform volume void fraction of about 0.61 and a preform volume Cr fraction of about 0.23. The above cited preforms are then infiltrated with molten Cu to produce contacts which have a 100% dense, porosity free microstructure. One embodiment of the improved contact comprises a Cr rich layer having about 25–30% by weight Cr, an intermediate Cr layer having about 15–25% Cr, a low Cr layer having about 5–15% Cr and a Cr poor layer having about 1–5% Cr. This embodiment has a Cr rich layer of about 0.5 to 10 mils thickness, an intermediate Cr layer of about 0.5 to 10 mils thickness, a low Cr layer of about 0.5 to 10 mils thickness, and a poor Cr layer of about 0.5 to 10 mils thickness. A copper conductive layer of about 250–375 mils is below the Cr poor layer. The improved contact has a Cu/Cr interface cohesive strength and the mating surface resists melting and erosion.

The method of making the improved electrical contact comprises the steps of selection and blending of Cr and Cu mixtures to form a blended powder, light sintering of said blended powder to produce rigid porous preforms and pressure infiltration and solidification of molten Cu in the porous Cu/Cr preforms to obtain a 100% dense, porosity free microstructure. The Cu and Cr powder selection, blending and sintering steps further comprise selecting a mixture of Cu and Cr powders. The powder is selected from the group consisting of 50% by weight Cr/50% by weight Cu of powder mesh size. (−325/−325) and a 25% by weight Cr/25% by weight Cr/50% by weight Cu of powder mesh size (−325/100–200/−325). The Cr and Cu mixtures are then blended to form a blended powder. The step of blending comprises blending for 35 to 50 minutes and pouring into a container. The blended powder is deoxidized and lightly sintered to form a rigid preform. The step of sintering further comprises treating with hydrogen to precoat/presinter at about 900° C. to 1100° C. for the Cu/Cr blended powder. The step of sintering takes about 20 to 40 minutes.

The steps of Cu pressure infiltration and solidification of said preforms further comprises placing the preform in a heated preform container, placing the preform container in a first chamber of a pressure chamber, placing a crucible containing deoxidized Cu in a second chamber, evacuating said pressure chambers, heating the Cu in the container to a temperature of about 1150° C. to 1200°, and heating the preform container to about 950° C. to 1000° C. Both molten Cu and the preform are kept at their respective temperatures for about 15 to 25 minutes. The molten Cu is then pressurized with $N_2$ gas to about 800 to 1100 Psi and transferred through a gating system to infiltrate said preform. The pressure infiltration and solidification of the preform produces a 100% dense, porosity free microstructure.

The apparatus for pressure casting a preform comprises a first chamber of a pressure chamber containing a sealed preform container in which a preform is placed, means for heating the preform container and the preform, a second chamber containing a crucible, heating means to keep a metal in the crucible molten, a gating system connecting the crucible in the second chamber to the preform container in the first chamber, means for evacuating the first and second chambers of the pressure chamber, and means for pressurizing the molten metal from the crucible into the preform container through said gating system. The first chamber and second chamber are physically separated chambers. The pressure in the second chamber containing the crucible ranges from 800 Psi to 1,100 Psi. The first chamber containing the preform is not pressurized during transfer. The metal in the crucible is heated to about 1150° C. to 1200° C. and the preform is heated to about 950° C. to 1000° C. The crucible and preform are held at their respective temperatures for about 15 to 25 minutes. The molten Cu is pressurized and transferred through the gating system to infiltrate the preheated preform. The pressure casting is a continuous operation.

The new porosity free contact has the following advantages over a powder metallurgical (P/M) product:

(a) The new contact is a 100% dense, porosity free material due to pressure application during infiltration and solidification.

(b) The new contact has lower oxide content resulting from the use of molten metal infiltration of Cu.

(c) The new contact has enhanced Cu/Cr interface cohesion strength and improved erosion behavior.

(d) The new contact has a lower gas content (e.g., $H_2$, $O_2$ and $N_2$), (e) The new contact has a more uniform distribution and if desired can have a tailored Cr distribution.

(f) The new contact has lower production costs than the powder metallurgical products of the prior art.

The new porosity free contact has the following advantages over a vacuum infiltrated product:

(a) minimal or zero shrinkage porosity with the new contact;

(b) a faster rate of infiltration of the preform;

(c) an enhanced Cr distribution, where there is less dissolution of Cr in the molten Cu; and (d) tailored compositional gradients, having a selectively engineered Cr distribution.

BRIEF DESCRIPTION OF THE DRAWINGS

A full understanding of the invention can be appreciated from the following detailed description of the invention when read with reference to the accompanying figures.

DESCRIPTION OF THE PREFERRED EMBODIMENT

Figure 1:
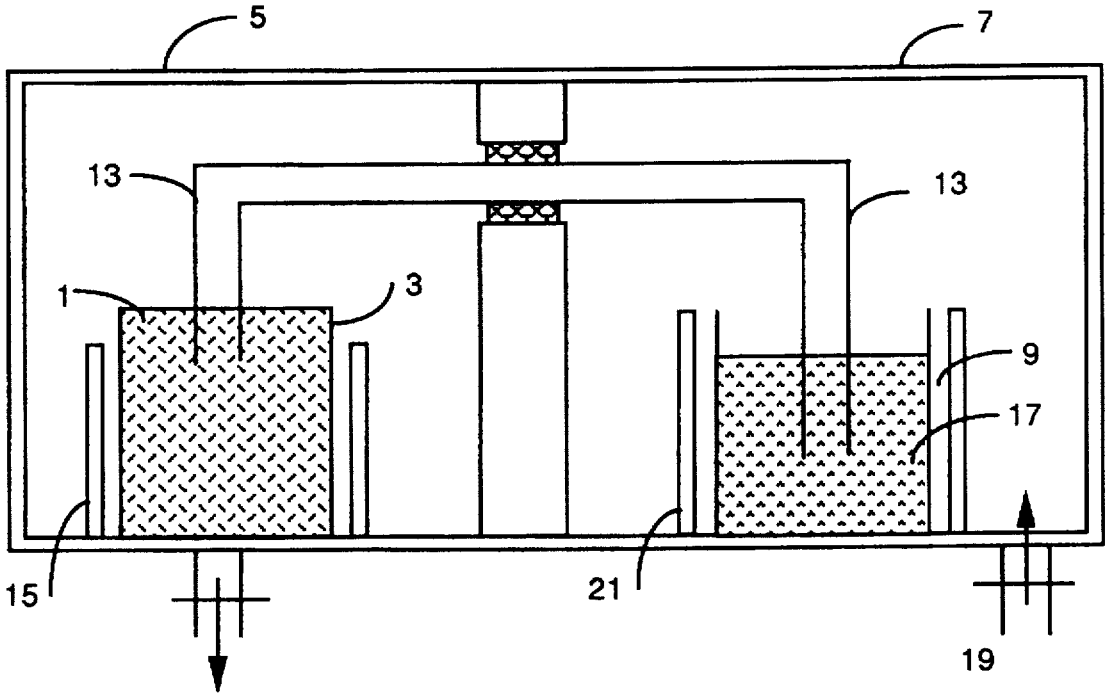
FIG. 1 shows the pressure casting apparatus of the present invention.

An improved contact is made from a blended Cr and Cu powder mixture. A contact made from the above powders is about 15–30% by weight Cr material. A 50% by weight Cr/50% by weight Cu of mesh size of about −325/−325 gives a preform volume void fraction of about 0.61 and a preform volume Cr fraction of about 0.22. A 25% by weight Cr/25% by weight Cr/50% by weight Cu of mesh size of about −325/100 to 200/−325 gives a preform volume void fraction of about 0.61 and a preform volume Cr fraction of about 0.23. The above cited preforms are infiltrated with molten Cu to form contacts which have a 100% dense, porosity free microstructure. One embodiment of the improved contact comprises a Cr rich layer having about 25–30% by weight Cr, an intermediate Cr layer having about 15–25% Cr, a low Cr layer having about 5–15% Cr and a Cr poor layer having about 1–5% Cr. The Cr rich layer is about 0.5 to 10 mils thick, the intermediate Cr layer is about 0.5 to 10 mils thick, the low Cr layer is about 0.5 to 10 mils thick, and the poor Cr layer is about 0.5 to 10 mils thick. A copper conductive layer of about 250–375 mils is below the Cr poor layer. The improved contact has a Cu/Cr interface cohesive strength and the matting surface resists melting and erosion.

A method to fabricate the new Cu—Cr electrical contacts comprises the following fabrication steps:

1. selection and blending of Cr/Cu powder mixture;
2. light sintering of a blended powder to produce a rigid, porous preform; and
3. Cu pressure infiltration and solidification in the porous Cu/Cr preform.

1. Cu and Cr Powder Selection and Blending

High purity Cr and Cu powders are used to make porous Cr/Cu based preforms. The powders are blended in a V-shaped blender for about 35 to 50 minutes, preferably 45 minutes and are gently and freely poured into graphite containers for subsequent light sintering. Blended mixtures of free (−325) mesh Cu and fine (−325) mesh Cr are used. This provides a contact with a homogeneous Cr distribution. In order to produce a contact containing a lower Cr fraction (e.g., 0.20 or 0.25 Cr), Cu powders are added to the Cr powder and they were blended together in a V-shaped blender. For example, when −325 mesh Cr and −325 mesh Cu powders were blended with a 1:1 mixing weight ratio, the final void fractional volume was 0.61. In this case, because of the presence of the Cu powders, the Cr volume fraction of the preform was 0.22. When an equal amount of −325 mesh Cu powder was added to a blend containing (−325) mesh Cr+(100–200) mesh Cr, the volume fractions of void and Cr were 0.58 and 0.23, respectively. This provides a contact with a graded Cr distribution. The various combinations of blended powder discussed are summarized hereinbelow.

| Powder Blend Composition (weight %) | Powder Mesh Size | Preform Vol. Void Fraction | Preform Vol. Cr. Fraction |
|---|---|---|---|
| 50 Cr/50 Cu | −325/−325 | 0.61 | 0.22 |
| 25 Cr/25 Cr/50 Cu | −325/100–200/−325 | 0.58 | 0.23 |

The void fractions are based on calculations given as follows:

| | | |
|---|---|---|
| Vv: | void volume fraction | |
| Vm: | metal volume fraction | |
| VCu: | Cu volume fraction | |
| VCr: | Cr volume fraction | |
| mCu: | weight of Cu powder | $Vv = 1 - Vm = 1 - (VCu - VCr)$ |
| mCr: | weight of Cr powder | $Vv = 1 - [\{(mCu/\rho Cu) + (mCr/\rho Cr)\}/Vt]$ |
| ρCu: | density of Cu (8.92 g/cc) | |
| ρCr: | density of Cr (7.2 g/cc) | |
| Vt: | total volume of preform based on shape (e.g., Vt: $\pi r^2 h$ for cylinder where | |

-continued

| |
|---|
| π: 3.14, r: radius of preform and h: height of preform) |

2. Light Sintering

The blended powder mixtures were carefully poured into cylindrical graphite molds. The molds were then placed in a hydrogen furnace. The powders were deoxidized and lightly sintered and came out of the furnace as rigid, handleable preforms. The temperatures for each 30 minutes sinter were about 900° C. to 1100° C., preferably about 1000° C. for Cu/Cr powder mixtures. All preforms had shrunk slightly due to the light sintering but were rigid enough to handle for pressure casting. The metallography of the preforms showed good macro-and microstructures with uniform powder distribution.

3. Pressure Infiltraation and Soldification of Preforms

The process of making infiltrated Cu/Cr contacts is outlined as follows and is shown in FIG. 1. The porous Cr/Cu based preforms were infiltrated with molten Cu in a closed chamber using pressurized nitrogen gas. First, a preform 1 was placed in a sealed steel container 3. The container 3 was then placed in the cold first chamber 5 of a pressure chamber. Pieces of oxygen free solid Cu are placed in a graphite crucible 9 in a second chamber 7 of the pressure chamber. The preform container is connected with the graphite crucible via a steel gating system 13. The chambers 5 and 7 were sealed, evacuated and the furnace heating systems 15 and 21 were turned on. The solid Cu melted and the temperature of the molten Cu 17 was allowed to reach about 1150° to 1180° C. The temperature of the steel preform container was independently controlled and kept at about 1150° C. to 1200° C. Keeping the temperature of the preform below the melting temperature of Cu is critical for two reasons: (1) Cu powders in the preform can remain solid, and (2) the degree of sintering in the preform (which will cause shrinkage in the preform) can be minimized. The molten Cu 17 and the preform 3 were held at the above temperatures for about 15 to 25 minutes. The second chamber 7 was then pressurized 19 from about 800 to 1100 Psi, preferably 1000 Psi, and the pressurized molten Cu is transferred through the gating system 13 into the preform 1.

Figure 2:
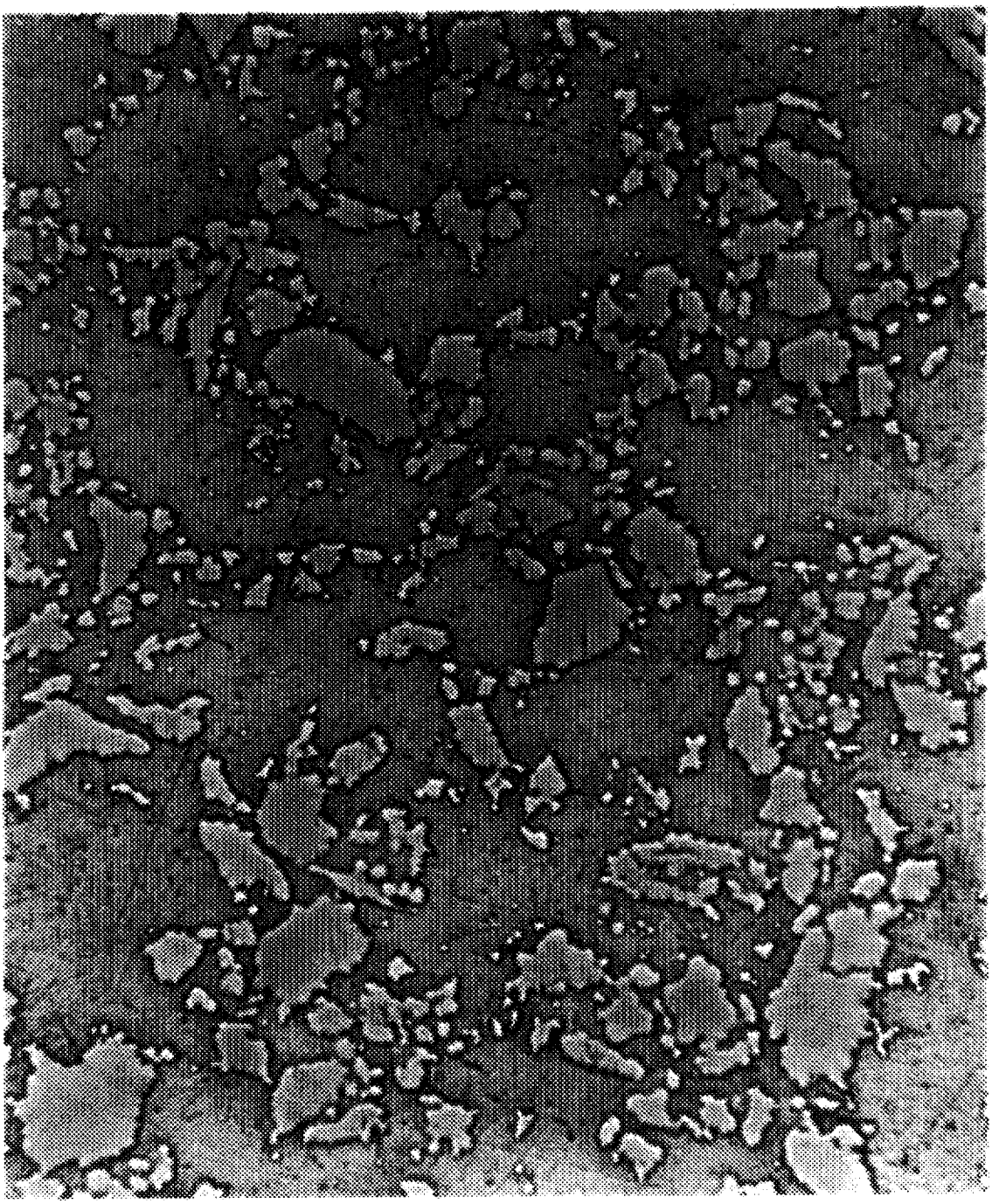
FIG. 2 shows the microstructure of the 100% dense, porosity free Cu—Cr contact produced by the pressure casting method of the present invention.
Figure 3:
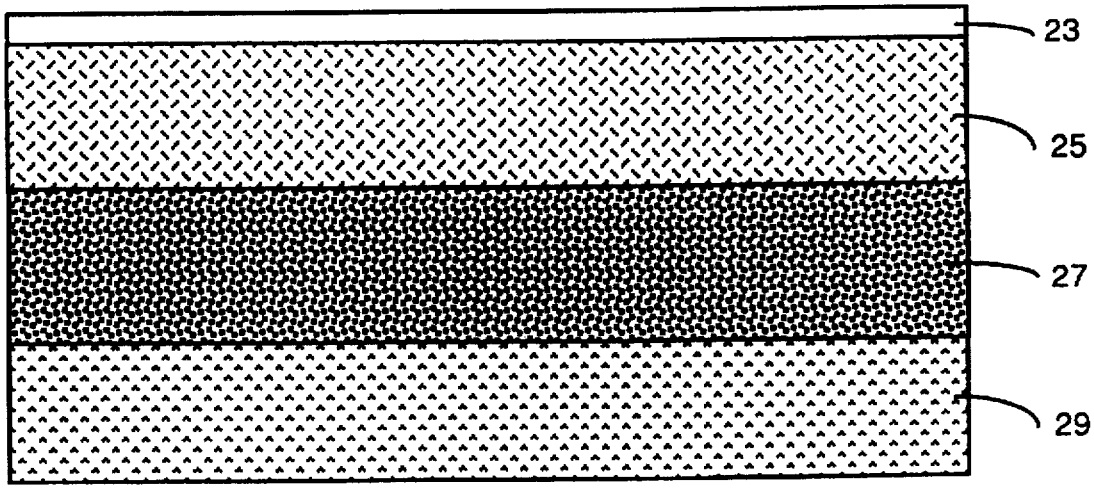
FIG. 3 shows a functionally graded contact of Cu and Cr.

The molten metal infiltration approach explained hereinabove differs from the existing prior art in the following ways:

1. This chamber has two independent, physically separated sections—a hot section and a cold section;
2. The cold section is under no applied pressure except inside the gating pipe. This is different than the prior art's approach where the preform containing molds or containers were under a pressurized atmosphere along with the molten metal. The merit of the new method is that this design reduces pressurization gas consumption, and therefore it can be more economical enabling the pressure levels to be increased to 10,000 Psi or higher if required. Currently, the pressure levels of the prior art are limited to pressures in the 1300–2500 Psi range.
3. FIG. 2 shows the microstructure of the 100% dense, porosity free Cu/Cr contact produced by the pressure casting method of the present invention.
4. Pressure east Cu/Cr materials of the present invention can be tailored to have functionally different regions in the contact. A functionally graded contact would have, for example, a Cr rich layer 23 with about 25–50% Cr which gives a high erosion resistance contact outer surface. Underneath is an intermediate Cr layer 25 with about 15–25% Cr; next a low Cr layer 27 with about 5–15% Cr and a Cr poor layer 29 of about 1–5% Cr. This is shown in FIG. 3. The Cr rich layer is about 0.5 to 10 mils thick, the intermediate Cr layer is about 0.5 to 10 mils thick and the Cr poor layer is about 0.5 to 10 mils thick. After the graded preform is pressure infiltrated with copper, a copper substrate of about 250 to 375 mils thick is layered on the Cr poor layer. In this way, the composition of the inner-bulk region of the contact can be diluted to improve thermal conductivity and to reduce the cost of raw materials via savings on expensive Cr consumption per contact. The melting temperature of the surface can be increased thereby and the erosion rate of the contact can be decreased.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting to the scope of the invention, which is to be given the full breadth of the appended claims.

We claim:

1. An improved electrical contact comprising an alloy of Cu and Cr having a 100% dense, porosity free microstructure, wherein the composition of said contact is about 15–30% by weight Cr material, wherein said alloy has one of a homogeneous Cr distribution and a graded Cr distribution, wherein a preform infiltrated with copper to form said contact is selected from the group consisting of a 25% by weight Cr/25% by weight Cr/50% by weight Cu and 50% by weight Cr/50% by weight Cu.

2. An improved electrical contact comprising an alloy of Cu and Cr having a 100% dense, porosity free microstructure, wherein the composition of said contact is about 15–30% by weight Cr material, wherein said alloy has one of a homogeneous Cr distribution and a graded Cr distribution, including a Cr rich layer having about 25–50% by weight Cr, an intermediate Cr layer having about 15–20% Cr, a low Cr layer having about 5–15% Cr and a Cr poor layer having about 1–5% Cr above a copper substrate.

3. The improved electrical contact of claim 5, wherein said Cr rich layer is about 0.5 to 10 mils thick, said intermediate Cr layer is about 0.5 to 10 mils thick, said low Cr layer is about 0.5 to 10 mils thick, and said Cr poor layer is about 0.5 to 10 mils thick.

* * * * *